US009508298B2

(12) United States Patent
Jang et al.

(10) Patent No.: US 9,508,298 B2
(45) Date of Patent: Nov. 29, 2016

(54) ADAPTIVE INVERSION CONTROL OF LIQUID CRYSTAL DISPLAY DEVICE

(71) Applicant: LG Display Co., Ltd., Seoul (KR)

(72) Inventors: Jaehyuk Jang, Daegu (KR); Kyuwon Sim, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/581,563

(22) Filed: Dec. 23, 2014

(65) Prior Publication Data

US 2015/0179126 A1 Jun. 25, 2015

(30) Foreign Application Priority Data

Dec. 23, 2013 (KR) ..... 10-2013-0161861

(51) Int. Cl.
*G09G 3/36* (2006.01)

(52) U.S. Cl.
CPC .... *G09G 3/3614* (2013.01); *G09G 2320/0247* (2013.01); *G09G 2330/02* (2013.01); *G09G 2330/026* (2013.01); *G09G 2330/027* (2013.01)

(58) Field of Classification Search
CPC ..... G09G 3/3614; G09G 3/3648
USPC ..... 345/55, 92–96, 98–100, 211
See application file for complete search history.

(56) References Cited

U.S. PATENT DOCUMENTS 6,525,708 B2 * 2/2003 Lin ..... G09G 3/3688 345/211
2007/0176866 A1 * 8/2007 Hung ..... G09G 3/3696 345/87
2011/0141098 A1 * 6/2011 Yaguma ..... G09G 3/3688 345/212
2013/0241900 A1 * 9/2013 Ge ..... G09G 3/006 345/204
2013/0265288 A1 * 10/2013 Woo ..... G09G 3/3614 345/209
2015/0002381 A1 * 1/2015 Fujioka ..... G09G 3/3614 345/87

FOREIGN PATENT DOCUMENTS

CN 101556776 A 10/2009
CN 102054454 A 5/2011
JP WO2013125406 * 2/2013 ..... G09G 36/14
KR 10-2007-0075696 A1 7/2007
KR 10-2013-0004954 A1 1/2013
TW 200504637 A 2/2005
TW 201335925 A 9/2013

(Continued)

OTHER PUBLICATIONS

Taiwan Office Action, Taiwan Application No. 103144148, Feb. 19, 2016, 5 pages.

(Continued)

*Primary Examiner* — Calvin C Ma
(74) *Attorney, Agent, or Firm* — Fenwick & West LLP

(57) ABSTRACT

A display device is disclosed. The display device includes a liquid crystal display panel; a data driver for driving the liquid crystal display panel in a first inversion manner; a timing controller for controlling the data driver; and a power converter for changing a first power voltage supplied from a power supply unit into a second power voltage and outputting the second power voltage, wherein, when the power of one of the power supply unit and the power converter is turned on after being abnormally turned off, the liquid crystal display panel is driven in a second inversion manner different from the first inversion manner.

11 Claims, 5 Drawing Sheets

(56) References Cited

FOREIGN PATENT DOCUMENTS

| | | | |
|---|---|---|---|
| TW | 201428726 | A | 7/2014 |
| TW | 201435852 | A | 9/2014 |

OTHER PUBLICATIONS

Chinese First Office Action, Chinese Application No. 201410816037.1, Aug. 1, 2016, 8 pages.

* cited by examiner

ADAPTIVE INVERSION CONTROL OF LIQUID CRYSTAL DISPLAY DEVICE

CROSS-REFERENCE TO RELATED APPLICATION

This application claims the benefit of Korean Patent Application No. 10-2013-0161861 filed on Dec. 23, 2013, which is incorporated herein by reference for all purposes as if fully set forth herein.

BACKGROUND

Field

This present disclosure relates to a liquid crystal display.

Description of the Related Art

With the development of information technology, the market of display devices, which are connection media between a user and information, is growing. Thus, usage of flat panel displays (FPDs), such as a liquid crystal display (LCD), an organic light emitting diode display (OLED), and a plasma display panel (PDP), has increased.

LCDs have various structures and are implemented in various driving manners. For some of the LCDs, the charges charged in pixels are discharged according to the off sequence when the power is normally turned off. However, the charges charged in all the pixels may not be discharged but instead remain when the power is abnormally turned off. In this case, the DC stress may be applied to the pixels, and a flicker phenomenon may occur on an LCD panel.

For some of the LCD proposed in the prior art, the DC stress applied to the pixels of the LCD panel causes a flicker phenomena, such as screen flickering, when the power is abnormally turned off.

SUMMARY

The present invention provides a liquid crystal display, including: a liquid crystal display panel; a data driver for driving the liquid crystal display panel in a first inversion manner; a timing controller for controlling the data driver; and a power converter for changing a first power voltage supplied from a power supply unit into a second power voltage and outputting the second power voltage, wherein, when a power of one of the power supply unit and the power converter is turned on after being abnormally turned off, the liquid crystal display panel is driven in a second inversion manner different from the first inversion manner.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENTS

Reference will now be made in detail embodiments of the invention examples of which are illustrated in the accompanying drawings.

Hereinafter, specific embodiments of the present invention will be described with reference to the accompanying drawings.

Figure 1:
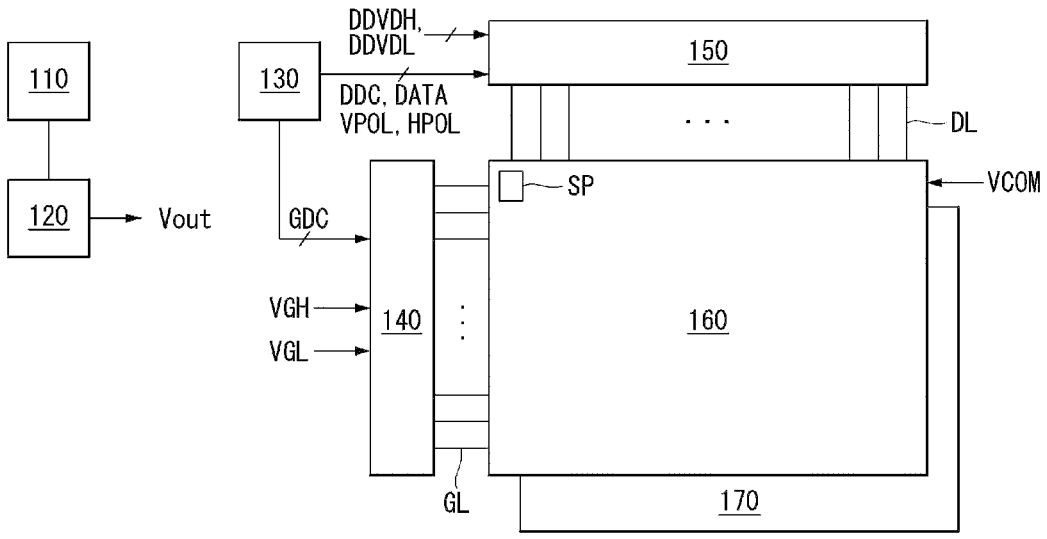
FIG. 1 is a block diagram schematically showing a liquid crystal display according to an embodiment of the present invention.
Figure 2:
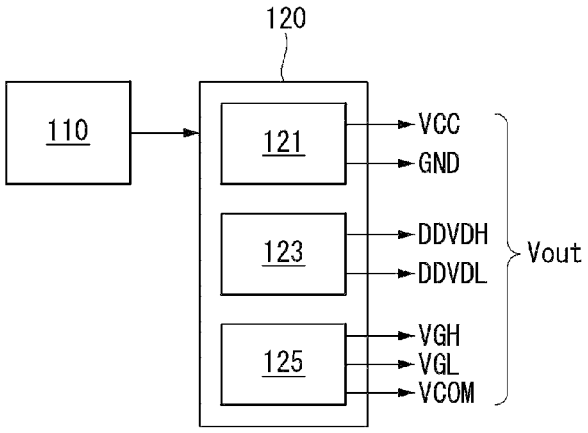
FIG. 2 is a diagram illustrating an exemplary structure of a power converter shown in FIG. 1.

FIG. 1 is a block diagram schematically showing a liquid crystal display according to an embodiment of the present invention; and FIG. 2 is a diagram illustrating a structure of a power converter shown in FIG. 1.

As shown in FIGS. 1 and 2, a liquid crystal display according to an embodiment of the present invention includes a power supply unit 110, a power converter 120, a timing controller 130, a gate driver 140, a data driver 150, a liquid crystal display panel 160, and a backlight unit 170.

The power supply unit 110 may be formed in various types according to the size of the liquid crystal display panel 160. In the case where the liquid crystal display panel 160 has a medium size or a large size (a monitor, TV, etc.), the power supply unit 110 may comprise a circuit which converts DC voltage into AC voltage and outputs the AC voltage. In the case where the liquid crystal display panel 160 has a small size (for example, for use in a smart phone, etc.), the power supply unit 110 may comprise a battery.

The power converter 120 converts a first power voltage outputted from the power supply unit 110 into a second voltage to output the second voltage. The power converter 120 may comprise a regulator (low dropout: LDO), a charge pump, a power chip, etc., and generate the output of power voltages Vout at various levels.

The power converter 120 may include a first power converter 121, a second power converter 123, and a third power converter 125, as shown in FIG. 2. The first power converter 121 may output a high voltage VCC and a ground voltage GND to be supplied to the timing controller 130, the gate driver 140, the data driver 150, the liquid crystal display panel 160, and the backlight unit 170. The second power converter 123 may output a first driving voltage DDVDH and a second driving voltage DDVDL to be supplied to the data driver 150. The third power converter 125 may output a gate high voltage VGH and a gate low voltage VGL to be supplied to the gate driver 140, and a common voltage VCOM to be supplied to the liquid crystal display panel 160. The common voltage VCOM may be outputted by a common voltage output unit which is separately configured.

The timing controller 130 controls operation timings of the data driver 150 and the gate driver 140 using timing controls, such as a vertical synchronization signal, a horizontal synchronization signal, a data enable signal, a clock signal, and the like. The timing controller 130 outputs a gate timing control signal GDC for controlling the operation timing of the gate driver 140, and a data timing control signal DDC for controlling the operation timing of the data driver 150. The timing controller 130 supplies the data timing control signal DDC and a data signal DATA to the data driver 150.

The gate driver 140 outputs a gate signal in response to the gate timing control signal GDC outputted from the timing controller 130. The gate driver 140 supplies the gate signal to the sub-pixels SP included in the liquid crystal display panel 160 through gate lines GL. The gate signal includes a gate high voltage VGH (or a gate on voltage) for turning on a switching transistor of the liquid crystal display panel 160 and a gate low voltage VGL (or a gate off voltage) for turning off the switching transistor of the liquid crystal display panel 160.

The data driver 150 samples and latches a data signal DATA in response to the data timing control signal DDC outputted from the timing controller 130, and converts and outputs the data signal DATA in response to a gamma reference voltage. The data driver 150 supplies the data signal DATA to the sub-pixels SP included in the liquid crystal display panel 160 through data lines DL.

The backlight unit 170 supplies light to the liquid crystal display panel 160. The backlight unit 170 comprises light emitting diodes (LEDs), an LED driver, a light guiding plate, optical sheets, and the like. The backlight unit 170 is formed in an edge type, a dual type, or a direct type. In the edge type, LEDs are disposed on one side surface of the liquid crystal display panel 160. In the dual type, LEDs are disposed on both side surfaces of the liquid crystal display panel 160. In the direct type, LEDs are disposed on a lower surface of the liquid crystal display panel 160.

The liquid crystal display panel 160 includes pixels for displaying an image in response to the gate signal outputted from the gate driver 140 and the data signal DATA outputted from the data driver 150. Each of the pixels comprises red, green, and blue sub-pixels. The sub-pixels of the liquid crystal display panel 160 are formed between a transistor array substrate and a color filter substrate. The transistor array substrate includes switching transistors, storage capacitors, and the like. The color filter substrate includes color filters, a black matrix, and the like.

The liquid crystal display panel 160 is implemented in a twisted nematic (TN) mode, a vertical alignment (VA) mode, an in-plane switching (IPS) mode, a fringe field switching (FFS) mode, or an electrically controlled birefringence (ECB) mode. Pixel electrodes for driving the liquid crystal layer are formed on the transistor array substrate, and a common electrode is formed on the transistor substrate or the color filter substrate depending on the mode of the liquid crystal layer.

Hereinafter, a liquid crystal display of the prior art and a liquid crystal display according to an embodiment of the present invention will be described through the comparison therebetween. Hereinafter, a small-sized liquid crystal display (for example, for a smart phone or the like) using a battery will be described as one embodiment in which the power can be abnormally turned off/on.

Figure 3:
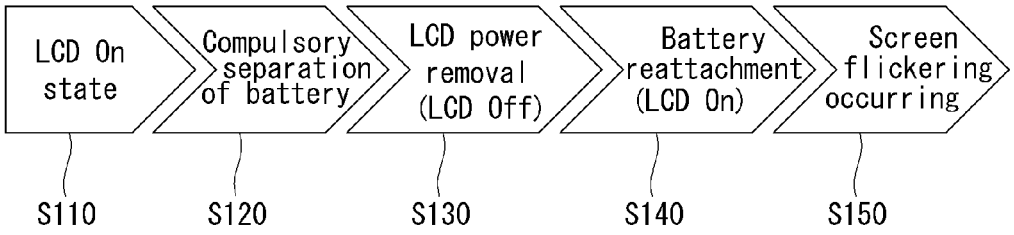
FIG. 3 is a flowchart illustrating the driving of a liquid crystal display of the prior art when the power is abnormally turned on/off.
Figure 4:
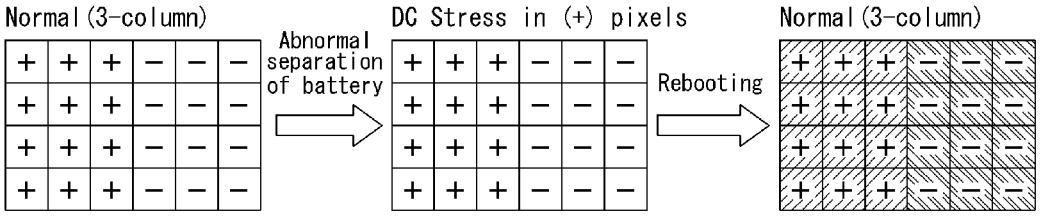
FIG. 4 is a diagram illustrating an inversion driving state of the liquid crystal display panel after rebooting in FIG. 3.
Figure 5:
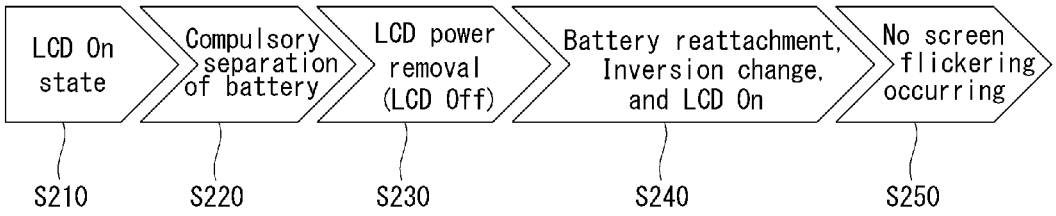
FIG. 5 is a flowchart illustrating the driving of a liquid crystal display according to an embodiment of the present invention when the power is abnormally turned on/off.
Figure 6:
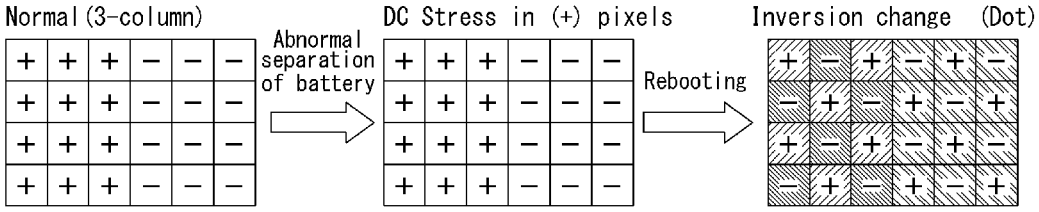
FIG. 6 is a diagram illustrating an inversion driving state of the liquid crystal display panel after rebooting in FIG. 5.

FIG. 3 is a flowchart illustrating the driving of a liquid crystal display of the prior art when the power is abnormally turned on/off; FIG. 4 is a diagram illustrating an inversion driving state of the liquid crystal display panel after rebooting in FIG. 3; FIG. 5 is a flowchart illustrating the driving of a liquid crystal display according to an embodiment of the present invention when the power is abnormally turned on/off; and FIG. 6 is a diagram illustrating an inversion driving state of the liquid crystal display panel after rebooting in FIG. 5.

PRIOR ART

As shown in FIG. 3, in a turn-on state (LCD On state), the liquid crystal display panel is turned on (S110). A battery for supplying the power to the liquid crystal display may be compulsorily separated, and the power of the liquid crystal display may be abnormally turned off (S120). As the battery is compulsorily separated, the power source of the liquid crystal display panel is removed (LCD Off state) (S130). The battery may be reattached to turn on the liquid crystal display panel (S140). Screen flickering may occur on a display surface of the liquid crystal display panel (S150).

As shown in FIG. 4, the liquid crystal display proposed in the prior art is driven in a 3-column inversion manner, which is a normal driving state, when the liquid crystal display panel is turned on. Because the 3-column inversion driving corresponds to a normal driving state, the 3-column inversion driving is performed even when the battery is abnormally separated. Even after the battery is reattached and the liquid crystal panel is again turned on, the liquid crystal display panel is driven in a 3-column inversion manner.

As can be seen through the above description, the liquid crystal display proposed in the prior art is driven in a 3-column inversion manner. Therefore, the DC stress is applied to the pixels of the liquid crystal display panel (DC Stress in (+) pixels). Thus, in the case where the power is abnormally turned on and off, screen flickering occurs by the DC stress applied to the pixels of the liquid crystal display panel.

That is, as for the liquid crystal display proposed in the prior art, the abnormal turning on and turning off of the power causes a flicker phenomenon, such as screen flickering occurring by the DC stress applied to the pixels of the liquid crystal display panel.

[Present Invention]

As shown in FIG. 5, in a turn-on state (LCD On state), the liquid crystal display panel is turned on (S210). A battery for supplying the power to the liquid crystal display may be compulsorily separated, and the power of the liquid crystal display may be abnormally turned off (S220). As the battery is compulsorily separated, the power source of the liquid crystal display panel is removed (LCD Off state) (S230). The battery may be reattached to turn on the liquid crystal display panel (S240). The inversion manner is changed in this case. Hence, screen flickering does not occur on a display surface of the liquid crystal display panel (S250).

As shown in FIG. 6, the liquid crystal display according to an embodiment of the present invention is driven in a 3-column inversion manner, which is a normal driving state, when the liquid crystal display panel is turned on. Because the 3-column inversion driving corresponds to a normal driving state, the 3-column inversion driving is performed even when the battery is abnormally separated. However, after the battery is reattached, the liquid crystal display panel is driven in a dot inversion manner instead of the 3-column inversion manner.

As can be seen through the above description, the liquid crystal display according to an embodiment of the present invention is driven in a 3-column inversion manner in a normal driving state. Therefore, the DC stress is applied to the pixels of the liquid crystal display panel (DC Stress in (+) pixels) in the normal driving state. In the case where the power is abnormally turned off and on, the inversion manner is changed into a dot inversion driving manner instead of a 3-column inversion driving manner in order to offset the DC stress applied to the pixels of the liquid crystal display panel.

Therefore, the screening flickering does not occur because the inversion manner is changed into the dot inversion driving instead of the 3-column inversion driving, thereby offsetting the brightness difference between the pixels to which DC stress is applied.

The liquid crystal display panel is driven in an inversion manner different from the previous manner so as to offset the brightness difference between the pixels to which DC stress is applied for a predetermined period of time, and after again driven in the previous original inversion manner. For example, the liquid crystal display panel is driven in an inversion manner different from a previous inversion manner during K frames (K is at least one frame), and then may be driven in the previous original inversion manner.

That is, as for the liquid crystal display according to an embodiment of the present invention, in the case where the power is abnormally turned off and on, the DC stress applied to the pixels of the liquid crystal display panel is offset, thereby eschewing a flicker phenomenon on the liquid crystal display panel.

Meanwhile, the above description has been made in the case where the liquid crystal display panel is driven in a 3-column inversion manner, the dot inversion driving is performed in order to offset the DC stress applied to the pixels of the liquid crystal display panel. However, the above description is for merely illustrating one embodiment of the present invention, and thus, in the case where the power is abnormally turned on and off, any other inversion driving manner can be applied to offset DC stress applied to the pixels of the liquid crystal display panel.

Hereinafter, examples for realizing a liquid crystal display according to an embodiment of the present invention will be described.

Figure 7:
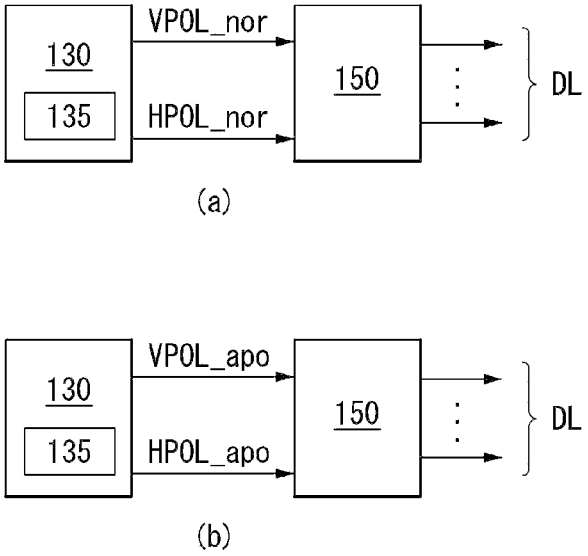
FIG. 7 is a diagram illustrating a first example for realizing a liquid crystal display according to an embodiment of the present invention.
Figure 8:
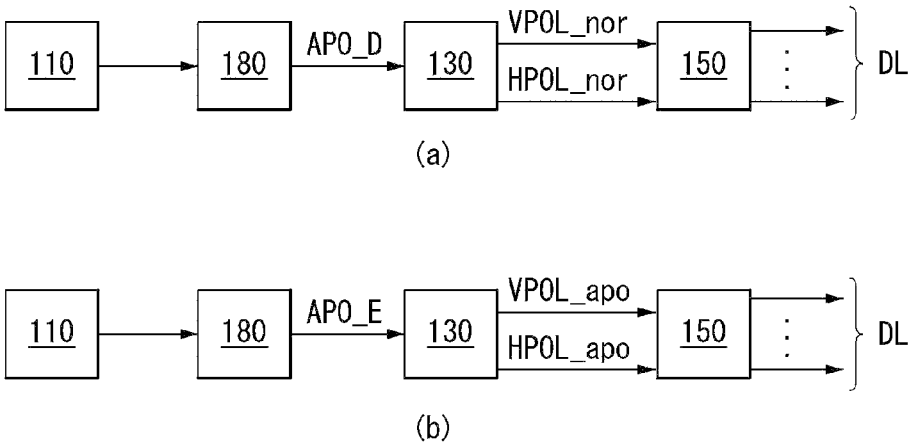
FIG. 8 is a diagram illustrating a second example for realizing a liquid crystal display according to an embodiment of the present invention.

FIG. 7 is a diagram illustrating a first example for realizing a liquid crystal display according to an embodiment of the present invention; and FIG. 8 is a diagram illustrating a second example for realizing a liquid crystal display according to an embodiment of the present invention.

First Example

As shown in FIG. 7, a timing controller 130 includes an inversion converter 135 which senses whether the power of a power supply unit (or a power converter) is normally turned off or abnormally turned off, and changes vertical and horizontal polarity control signals VPOL and HPOL in response to the sensed result. The vertical polarity control signal VPOL is a signal which controls the polarity in a vertical direction, and the horizontal polarity control signal HPOL controls the polarity in a horizontal direction.

In the first example for realizing a liquid crystal display according to an embodiment of the present invention, it is sensed whether the power was normally turned off or abnormally turned off, using the inversion converter 135 included in the timing controller 130. The inversion converter 135 can sense whether the power is normally turned off or abnormally turned off by receiving a flag with respect to a particular state from the outside.

As shown in (a) of FIG. 7, when the power of the power supply unit (or the power converter) is normally turned off, the inversion converter 135 generates a first vertical polarity control signal VPOL_nor and a first horizontal polarity control signal HPOL_nor for normally driving a liquid crystal display panel. The timing controller 130 supplies, to a data driver 150, the first vertical polarity control signal VPOL_nor and the first horizontal polarity control signal HPOL_nor generated from the inversion converter 135.

When the first vertical polarity control signal VPOL_nor and the first horizontal polarity control signal HPOL_nor are supplied from the timing controller 130, the data driver 150 drives the liquid crystal display panel in a first inversion manner. The first inversion manner may be selected as a 3-column inversion manner as shown in FIG. 6, but is not limited thereto.

As shown in (b) of FIG. 7, when the power of the power supply unit (or the power converter) is abnormally turned off, the inversion converter 135 generates a second vertical polarity control signal VPOL_apo and a second horizontal polarity control signal HPOL_apo for abnormally driving the liquid crystal display panel. The timing controller 130 supplies, to the data driver 150, the second vertical polarity control signal VPOL_apo and the second horizontal polarity control signal HPOL_apo generated from the inversion converter 135.

When the second vertical polarity control signal VPOL_apo and the second horizontal polarity control signal HPOL_apo are supplied from the timing controller 130, the data driver 150 drives the liquid crystal display panel in a second inversion manner different from the first inversion manner. The polarity of the second inversion manner is entirely or partly different from that of the first inversion manner. For example, the second inversion manner may be selected as a dot inversion manner as shown in FIG. 6, but is not limited thereto.

Meanwhile, the inversion converter 135 changes the second vertical polarity control signal VPOL_apo and the second horizontal polarity control signal HPOL_apo into the first vertical polarity control signal VPOL_nor and the first horizontal polarity control signal HPOL_nor, respectively, after a predetermined period of time.

That is, the inversion converter 135 inverts the horizontal and vertical polarity control signals HPOL and VPOL to allow the liquid crystal display panel to be driven in an original normal inversion driving manner. Therefore, the data driver 150 drives the liquid crystal display panel by changing the second inversion manner into the first inversion manner after a predetermined period of time.

Second Example

As shown in FIG. 8, a power sensor 180 senses whether the power of a power supply unit 110 (or a power converter) is normally turned off or abnormally turned off, and outputs a sense signal APO in response to the sensed result. A timing controller 130 changes and outputs polarity control signals VPOL and HPOL in response to the sense signal APO supplied from the power sensor 180.

In the second example for realizing a liquid crystal display panel according to an embodiment of the present invention, the power sensor 180 is used to sense whether the power of the power supply unit 110 (or power converter) is normally turned off or abnormally turned off.

The timing controller 130 changes the vertical and horizontal polarity control signals VPOL and HPOL based on the sense signal corresponding to the sensed result of the power sensor 180. The vertical polarity control signal VPOL is a signal which controls the polarity in a vertical direction, and the horizontal polarity control signal HPOL controls the polarity in a horizontal direction.

As shown in (a) of FIG. 8, when the power of the power supply unit 110 (or the power converter) is normally turned off, the power sensor 180 generates a deactivation signal APO_D and supplies the deactivation signal APO_D to the timing controller 130. The deactivation signal APO_D may be a logic low (or logic high) signal.

The timing controller 130 supplies the first vertical polarity control signal VPOL_nor and the first horizontal polarity control signal HPOL_nor for normally driving the liquid crystal display panel to the data driver 150 in response to the deactivation signal APO_D.

When the first vertical polarity control signal VPOL_nor and the first horizontal polarity control signal HPOL_nor are supplied from the timing controller 130, the data driver 150 drives the liquid crystal display panel in a first inversion manner. The first inversion manner may be selected as a 3-column inversion manner as shown in FIG. 6, but is not limited thereto.

As shown in (b) of FIG. 8, when the power of the power supply unit 110 (or the power converter) is abnormally turned off, the power sensor 180 generates an activation signal APO_E and supplies the activation signal APO_E to the timing controller 130. The activation signal APO_E may be a logic high (or logic low) signal.

The timing controller 130 supplies the second vertical polarity control signal VPOL_apo and the second horizontal polarity control signal HPOL_apo for abnormally driving the liquid crystal display panel to the data driver 150 in response to the activation signal APO_E.

When the second vertical polarity control signal VPOL_apo and the second horizontal polarity control signal HPOL_apo are supplied from the timing controller 130, the data driver 150 drives the liquid crystal display panel in a second inversion manner different from the first inversion manner. The polarity of the second inversion manner is entirely or partly different from that of the first inversion manner. For example, the second inversion manner may be selected as a dot inversion manner as shown in FIG. 6, but is not limited thereto.

Meanwhile, the timing controller 130 changes the second vertical polarity control signal VPOL_apo and the second horizontal polarity control signal HPOL_apo into the first vertical polarity control signal VPOL_nor and the first horizontal polarity control signal HPOL_nor, respectively, after a predetermined period of time.

That is, the timing controller 130 inverts the horizontal and vertical polarity control signals HPOL and VPOL to allow the liquid crystal display panel to be driven in an original normal inversion manner. Therefore, the data driver 150 drives the liquid crystal display panel by changing the second inversion manner into the first inversion manner after a predetermined period of time.

According to an embodiment of the present invention, a method of temporarily changing the vertical and horizontal polarity control signals depending on whether the power is normally turned off or abnormally turned off may be realized by an algorithm as shown in the first example or may be realized by a circuit and an algorithm as shown in the second example.

As set forth above, according to the present invention, the inversion manner is temporarily changed depending on whether the power is normally turned off or abnormally turned off, thereby offsetting the DC stress applied to the pixels of the liquid crystal display panel and improving the display quality and reliability.

What is claimed is:

1. A liquid crystal display, comprising:

a liquid crystal display panel;

a data driver for driving the liquid crystal display panel in a first inversion manner;

a timing controller for controlling the data driver; and a power converter for supplying power to the data driver based on an input power from a power supply unit, wherein the timing controller is configured to generate a polarity control signal, responsive to sensing either the power supply unit or the power converter being turned on after being abnormally turned off, the polarity control signal to cause the data driver to drive the liquid crystal display panel in a second inversion manner different from the first inversion manner.

2. The liquid crystal display of claim 1, wherein the polarity control signal temporarily causes the data driver to change an inversion manner of the liquid crystal display panel from the first inversion manner into the second inversion manner.

3. The liquid crystal display of claim 1, wherein responsive to the sensing said either the power supply unit or the power converter being turned on after being abnormally turned off, the polarity control signal causes the data driver to drive the liquid crystal display panel in the second inversion manner different from the first inversion manner during K frames (K is at least one frame), and then to drive the liquid crystal display panel in the first inversion manner.

4. The liquid crystal display of claim 1, wherein a polarity of the second inversion manner is entirely or partly different from that of the first inversion manner.

5. The liquid crystal display of claim 1, wherein the timing controller comprises an inversion converter to sense whether said either the power supply unit or the power converter is normally turned off or abnormally turned off, and to change vertical and horizontal polarity control signals in response to the sensed result.

6. The liquid crystal display of claim 5, wherein the inversion converter generates a first vertical polarity control signal and a first horizontal polarity control signal for normally driving the liquid crystal display panel responsive to said either the power supply unit or the power converter being normally turned off, and generates a second vertical polarity control signal and a second horizontal polarity control signal for abnormally driving the liquid crystal display panel responsive to said either the power supply unit or the power converter being abnormally turned off.

7. The liquid crystal display of claim 1, further comprising a power sensor for sensing whether said either the power supply unit or the power converter is normally turned off or abnormally turned off, and outputting a sense signal corresponding to the sensed result.

8. The liquid crystal display of claim 7, wherein the timing controller changes vertical and horizontal polarity control signals in response to the sense signal.

9. The liquid crystal display of claim 8, wherein the timing controller, in response to the sense signal, generates a first vertical polarity control signal and a first horizontal polarity control signal for normally driving the liquid crystal display panel, or generates a second vertical polarity control signal and a second horizontal polarity control signal for abnormally driving the liquid crystal display panel.

10. The liquid crystal display of claim 1, wherein the first inversion manner is a 3-column inversion manner, and the second inversion manner is a dot inversion manner.

11. The liquid crystal display of claim 1, wherein said either the power supply unit or the power converter is abnormally turned off without performing an off-sequence for discharging charges stored in pixels of the liquid crystal display panel.

* * * * *